US008657170B2

(12) United States Patent
Martinez

(10) Patent No.: US 8,657,170 B2
(45) Date of Patent: Feb. 25, 2014

(54) FALSE EYELASH DISPENSER

(76) Inventor: Lynda Martinez, Richardson, TX (US)

( * ) Notice: Subject to any disclaimer, the term of this patent is extended or adjusted under 35 U.S.C. 154(b) by 212 days.

(21) Appl. No.: 13/068,978

(22) Filed: May 24, 2011

(65) Prior Publication Data

US 2012/0000957 A1 Jan. 5, 2012

Related U.S. Application Data

(60) Provisional application No. 61/396,050, filed on May 24, 2010.

(51) Int. Cl.
*B65H 35/06* (2006.01)
*A41G 5/02* (2006.01)

(52) U.S. Cl.
USPC ..... 225/39; 225/57; 132/216

(58) Field of Classification Search
USPC ..... 225/39, 37, 34, 45, 46, 80, 106, 7, 35, 225/38, 36, 40, 42, 77; 221/39, 199; 242/560, 597.4, 593, 594.5; 156/577, 156/523, 527, 538, 574, 579, 540
See application file for complete search history.

(56) References Cited

U.S. PATENT DOCUMENTS

| | | | | |
|---|---|---|---|---|
| 5,556,469 | A * | 9/1996 | Koyama et al. | 118/257 |
| 6,270,578 | B1 * | 8/2001 | Murakoshi | 118/257 |
| 6,453,968 | B1 * | 9/2002 | Hsu | 156/577 |
| D466,554 | S * | 12/2002 | Yonezawa et al. | D19/67 |
| 6,521,045 | B1 * | 2/2003 | Koyama et al. | 118/257 |
| 6,739,369 | B2 * | 5/2004 | Watanabe | 156/577 |
| 2005/0139327 | A1 * | 6/2005 | Mitsui et al. | 156/577 |
| 2005/0178507 | A1 * | 8/2005 | Hajny et al. | 156/538 |
| 2009/0095428 | A1 * | 4/2009 | Schwertfeger et al. | 156/510 |

* cited by examiner

*Primary Examiner* — Ghassem Alie
(74) *Attorney, Agent, or Firm* — Thrasher Associates

(57) ABSTRACT

The invention is an apparatus that dispenses false eyelashes. The apparatus uses tape attached to the false eyelashes spun about a cylinder that the eyelashes spin off to a point at the front of the apparatus where the false eyelashes separate from the tape and the tape then rolls on to a second cylinder. In one embodiment, the apparatus's casing may be separated and the cylinders removed so new ones can be added to replace the old.

6 Claims, 4 Drawing Sheets

FALSE EYELASH DISPENSER

This application claims priority to U.S. Provisional Patent Application No. 61/396,050 to common inventor Melendez, dated 24 May 2010 and entitled False Eyelashes Systems and Methods.

FIELD OF INVENTION

The present invention relates generally to cosmetics, and more particularly to false eyelashes.

PROBLEM STATEMENT

Interpretation Considerations

This section describes the technical field in more detail, and discusses problems encountered in the technical field. This section does not describe prior art as defined for purposes of anticipation or obviousness under 35 U.S.C. section 102 or 35 U.S.C. section 103. Thus, nothing stated in the Problem Statement is to be construed as prior art.

Discussion

False eyelashes must be purchased and applied for all types of eyelid shapes, sizes, eyelash colors, and a host of other factors. This level of customization has led to eyelashes that are quite expensive, and which are stored in bulky containers which are expensive to ship.

Another problem encountered with applying false eyelashes is handling and applying false eyelashes can be cumbersome, messy, and inaccurate. With current available products, applying false eyelashes takes skill and practice. One must use glue to adhere the false eyelashes to the eyelids. One must let the glue get the correct amount of "tackiness" and then apply without gumming up the eyelashes and ruining the product, or worse, damaging the eye itself. Although there are false eyelashes available with self-adhesive glue already on the lashes, these leave the glue residue on the real eyelashes and can result in removing the person's own lashes along with the false eyelashes.

To be applied properly, a false eyelash needs the correct amount of adhesive and size, the present invention solves those and other problems.

BRIEF DESCRIPTION OF THE DRAWINGS

Various aspects of the invention, as well as an embodiment, are better understood by reference to the following detailed description. To better understand the invention, the detailed description should be read in conjunction with the drawings and tables, in which.

EXEMPLARY EMBODIMENT OF A BEST MODE

Interpretation Considerations

Figure 1:
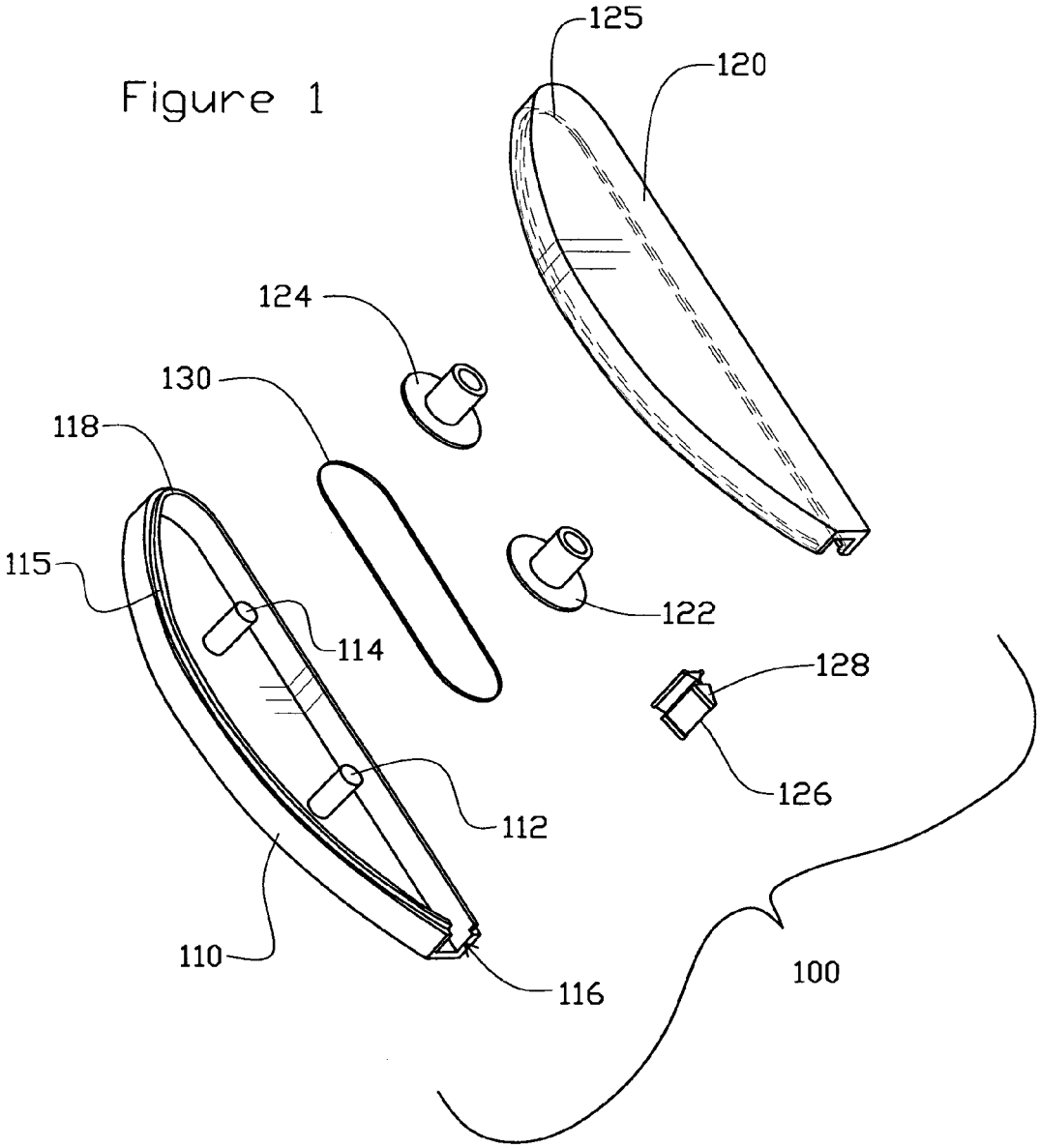
FIG. 1 shows each of the individual components of the false eyelash dispenser.

When reading this section (An Exemplary Embodiment of a Best Mode, which describes an exemplary embodiment of the best mode of the invention, hereinafter "exemplary embodiment"), one should keep in mind several points. First, the following exemplary embodiment is what the inventor believes to be the best mode for practicing the invention at the time this patent was filed. Thus, since one of ordinary skill in the art may recognize from the following exemplary embodiment that substantially equivalent structures or substantially equivalent acts may be used to achieve the same results in exactly the same way, or to achieve the same results in a not dissimilar way, the following exemplary embodiment should not be interpreted as limiting the invention to one embodiment.

Likewise, individual aspects (sometimes called species) of the invention are provided as examples, and, accordingly, one of ordinary skill in the art may recognize from a following exemplary structure (or a following exemplary act) that a substantially equivalent structure or substantially equivalent act may be used to either achieve the same results in substantially the same way, or to achieve the same results in a not dissimilar way.

Accordingly, the discussion of a species (or a specific item) invokes the genus (the class of items) to which that species belongs as well as related species in that genus. Likewise, the recitation of a genus invokes the species known in the art. Furthermore, it is recognized that as technology develops, a number of additional alternatives to achieve an aspect of the invention may arise. Such advances are hereby incorporated within their respective genus, and should be recognized as being functionally equivalent or structurally equivalent to the aspect shown or described.

Second, the only essential aspects of the invention are identified by the claims. Thus, aspects of the invention, including elements, acts, functions, and relationships (shown or described) should not be interpreted as being essential unless they are explicitly described and identified as being essential. Third, a function or an act should be interpreted as incorporating all modes of doing that function or act, unless otherwise explicitly stated (for example, one recognizes that "tacking" may be done by nailing, stapling, gluing, hot gunning, riveting, etc., and so a use of the word tacking invokes stapling, gluing, etc., and all other modes of that word and similar words, such as "attaching").

Fourth, unless explicitly stated otherwise, conjunctive words (such as "or", "and", "including", or "comprising" for example) should be interpreted in the inclusive, not the exclusive, sense. Fifth, the words "means" and "step" are provided to facilitate the reader's understanding of the invention and do not mean "means" or "step" as defined in §112, paragraph 6 of 35 U.S.C., unless used as "means for -functioning-" or "step for -functioning-" in the Claims section. Sixth, the invention is also described in view of the Festo decisions, and, in that regard, the claims and the invention incorporate equivalents known, unknown, foreseeable, and unforeseeable. Seventh, the language and each word used in the invention should be given the ordinary interpretation of the language and the word, unless indicated otherwise.

It should be noted in the following discussion that acts with like names are performed in like manners, unless otherwise stated. Of course, the foregoing discussions and definitions are provided for clarification purposes and are not limiting. Words and phrases are to be given their ordinary plain meaning unless indicated otherwise.

DESCRIPTION OF THE DRAWINGS

The present invention is an apparatus that stores and delivers false eyelashes ("lashes on tape") conveniently in a manner that allows for easy and accurate application of false eyelashes that are "cut" to the user's appropriate length. As such, the invention comprises false eyelashes that are coupled to eyelash tape, which is itself coupled to a paper or tape backing via an adhesive. The eyelashes may be pre-sized, or continuous so that a user may either tear or cut the eyelashes to the desired length.

Common eyelash types include human hairs, synthetic hairs, nylon, fibers, threads, or even fiber optics. The tape is preferably medical-grade, fabric-covered tape. However, other types of tapes are functional equivalents, such as plastics. Preferred adhesives include medical grade such as Elastoplast®, and are sufficiently tacky to secure the false eyelashes to an eyelid, but not so tacky as to harm the eyelid.

Shown in FIG. 1 are the basic components of the false eyelash dispenser apparatus 100. The casing is defined by a first body 110 and a second body 120. The first and second bodies 110, 120 connect together as the casing. The connection is simple snap rivets 115, 125. The first body 110 can have openings along the edge and the second body 120 has the male ends that pop into those openings. The rivets 115, 125 can be pushed in order to separate the first and second bodies 110, 120 for refill purposes. The first body 110 has affixed to it a front axle 112 approximate to the opening 116 and a rear axle 114 approximate to the back end 118 of the first body 110. The front axle 112 operates as the receiving cylinder in that it supports a first wheel that receives the tape after the false eyelash has been removed. The second wheel 124 rests on the rear axle 114 having the false eyelashes thereon. Accordingly, the false eyelash tape unspools from the second wheel 124 to the first wheel 122 as the false eyelashes are removed and presumably used. A removal tip 126 operates to separate the tape and false eyelash then the false eyelash is removed. A guide plate 128 is added to keep the false eyelash and tape on the removal tip 126. An elastic tension element 130 is used for the first wheel 122 to operate, drive, the second wheel 124.

Figure 2:
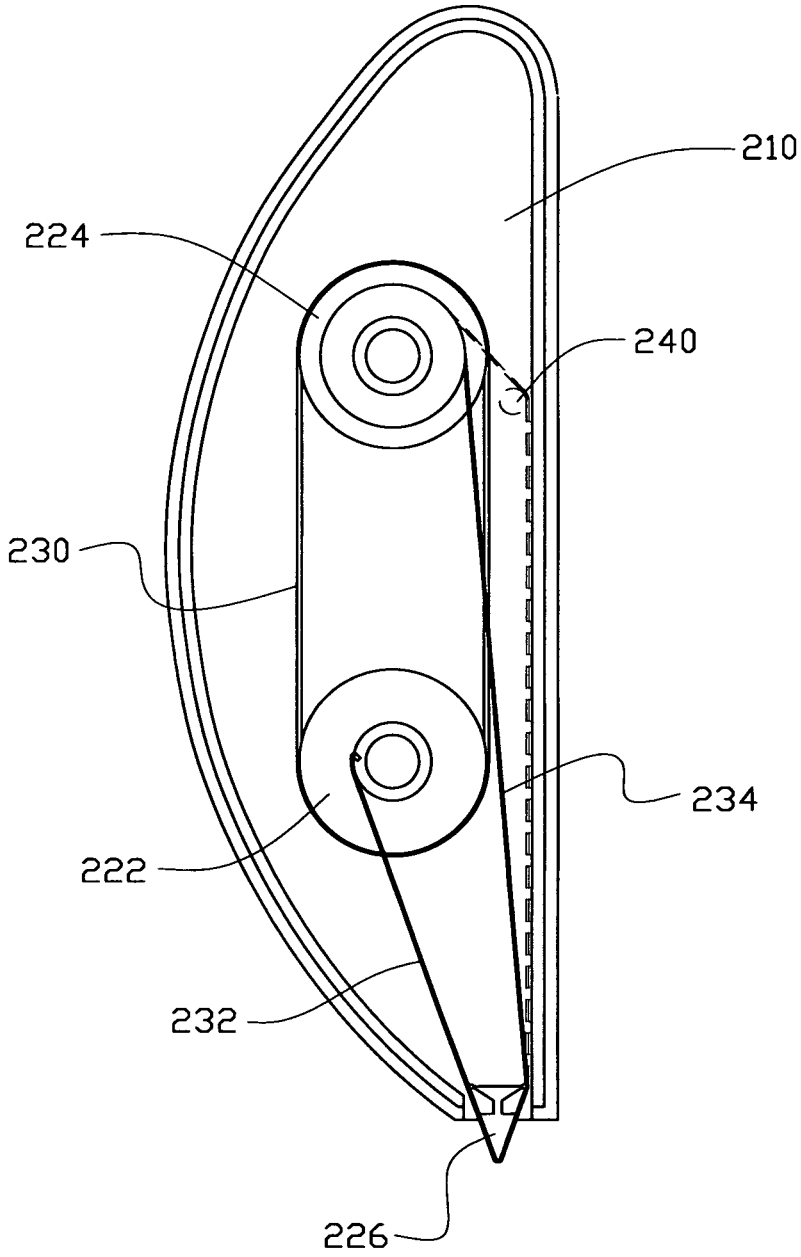
FIG. 2 shows the cross sectional side view of the eyelash tape dispenser.

Shown in FIG. 2 is a side view of the false eyelash dispenser with the second body removed. The first body 210 is the place holder that holds all of the components in position so that the process can be performed properly. The first wheel 222 is placed on the front axle. The first wheel 222 receives the tape 232 after the false eyelash has been removed. The false eyelash dispenser is started by adding a false eyelash tape roll on the second wheel 224 which is one the rear axle. The tape first end 232 is pulled manually around the removal tip 226 then attached to the first wheel 222. The tape first end 232 is secures to the first wheel 222. The tape first end 232 can be secured by adhesive, a small screw, or a lock pin. After the tape first end 232 has been secured, the apparatus can operate. The tape 234 starts on the second wheel 224 with the false eyelash still attached and is pulled from the second wheel 224 to the eyelash removal tip 226, where the false eyelash is removed from the tape 234. The removal tip 226 creates a sharp angle that operates to separate the false eyelash from the tape 234 with ease. The false eyelash has adhesive on it that sticks to the tape 234, but is also manually removable from the tape as well. After the false eyelash is removed, the tape 234 is pulled by the first wheel 222 where it winds onto the first wheel 222 until all false eyelashes have been removed and the tape is completely wound around the first wheel 222. At this point, the tape 234 is in a roll and can be uncoupled from the first wheel 222 and removed. A new roll of false eyelash tape is added to refill the second wheel 224 and the tape first end 232 is manually pulled around the removal tip 226 and secured to the first wheel 222 and the apparatus is ready to operate again.

The elastic tension element 230 is encompasses the first wheel 222 and the second wheel 224. The friction of the elastic tension element 230 functions to keep the first wheel 222 and second wheel 224 in consistent flow. The apparatus can operate by the first wheel 222 and the second wheel 224 being gears and those gears being uniformly in size to operate consistently with each other. In that apparatus, the first wheel 222 is the drive gear and the second wheel 224 is the driven gear. A combination of an elastic tension element and gears can also be used. An elastic tension element can be a rubber band or a rubber ring.

Shown FIG. 2 is an additional cylindrical peg 240. The peg 240 operates as an additional mechanism to help the apparatus operate more smoothly and keep the tape 234 from becoming entangled before and after the removal tip 226. When a new false eyelash roll is added, the tape 234 is placed underneath the peg 240 so that it runs from the second wheel 224 around the peg 240 to and around the removal tip 226 and to the first wheel 222. Additional pegs can be added to increase stability of the tape 234 so that it stays on the proper path and doesn't become entangled.

Figure 3:
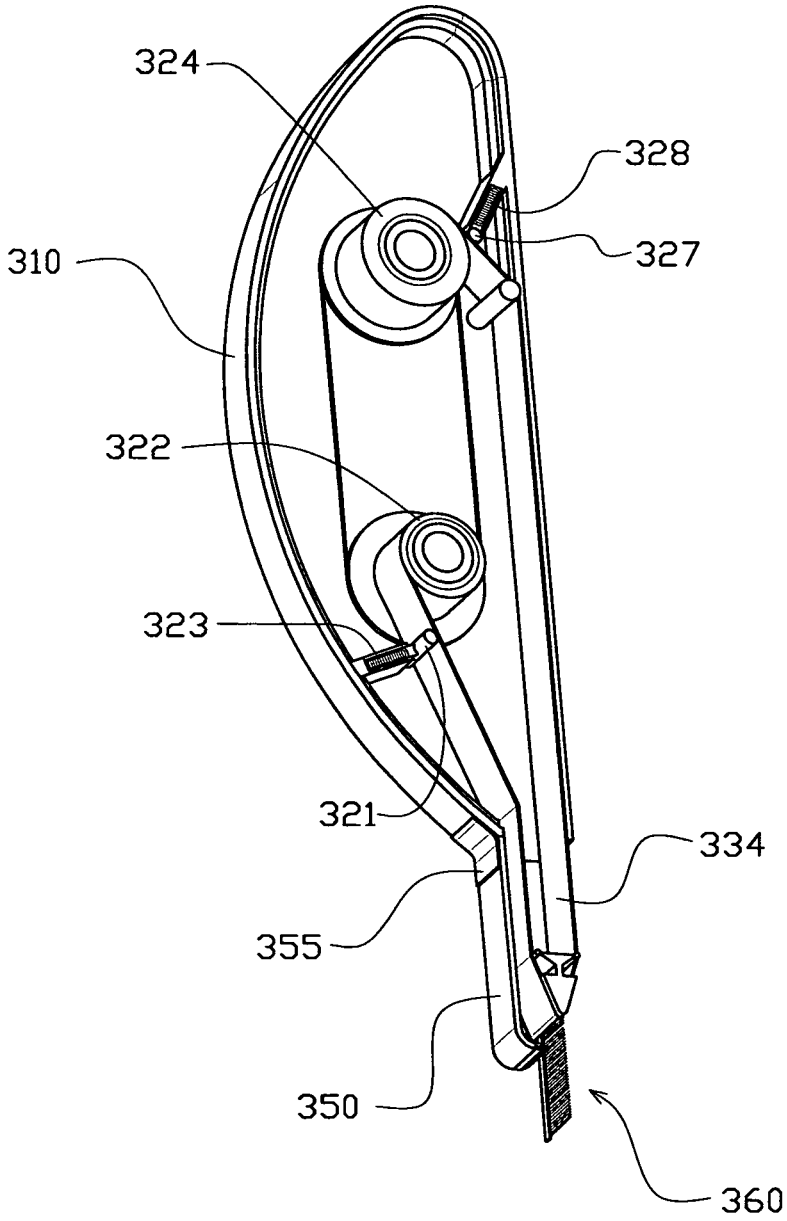
FIG. 3 shows an isometric side view of the eyelash dispenser with additional features.

FIG. 3 is a side view of the apparatus and shows additional features that can be added to the apparatus increase operation efficiency. A cutter 350 is used to cut the false eyelash 360 to specific size. Various sizes of false eyelashes are needed for various people, adding the cutter 350 increases precision of the false eyelash dispenser. The cutter 350 operates on a hinge 355 where the cutter 350 is coupled to the first body 310 of the casing. The tape 334 is guided by additional guide pins and compression springs. The first guide rod 321 adds pressure to the tape 334 on the first wheel 322 via a first compression spring 323 which is attached to the first body 310. A second guide rod 327 adds pressure to the tape and false eyelashes 334 via a compression spring 328. The compression springs adjust to the amount of the roll decreasing in size or increasing in size in order to keep pressure on the tape 334 to assist with control.

Figure 4:
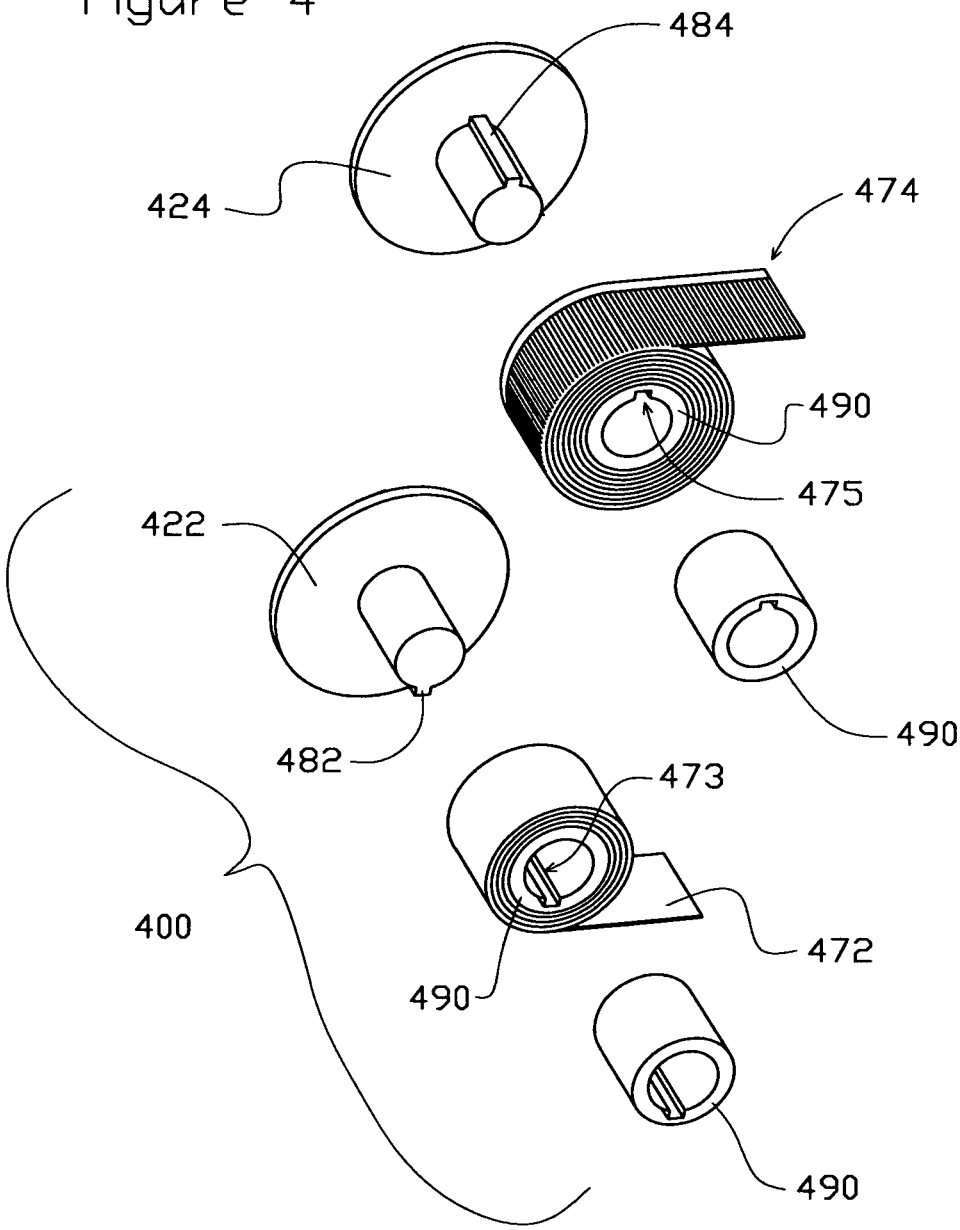
FIG. 4 shows the first and second wheels with false eyelash and tape rolls with reels.

FIG. 4 is the isometric view of the first wheel 422 and the second wheel 424 with the tape with false eyelash roll 474, the second roll 474 which is on a reel 490 and the tape without false eyelash roll 472, the first roll 472, which is also on a reel 490. The reel 490 fits over the cylinder on the first wheel 422 or the cylinder on second wheel 424. The reels 490 allows for more efficiently refilling the apparatus. The reels 490 slide easily on and off the first and second wheels 422, 424 respectively. Each reel 490 has a groove 473, 475 that line up with guide pins 482, 484 on the respective wheels 422, 424. These guide pins 482, 484 allow the reels 490 to slide on and off the first and second wheels 422, 424 freely, but while on those wheels, the reels 490 rolls 472, 474 are spun consistently.

When starting the apparatus, an empty reel 490 is placed on the first wheel 422 and a tape with false eyelash roll 474 is placed on the second wheel 424. The tape is then manually fed through the apparatus as discussed and shown in previous figures and then attached to the empty roll 490. After all the false eyelashes have been removed, an empty roll 490 will be left on the second wheel 424 and a tape without eyelash roll 472 will be on the first wheel. Both rolls 472, 474 will be removed. The empty reel 490 can be moved from the second wheel 424 and placed on the first wheel 422. A reel 490 with new tape with false eyelash roll 474 will be added to the second wheel 424, the tape manually fed and attached to the empty roll 490 and then the apparatus is successfully refilled. The apparatus can then dispense false eyelashes again.

Of course other features and embodiments are readily apparent, in one embodiment the invention provides black, brown or brownish/black "tape" that acts as eyeliner and functions as tape adhesive with false eyelashes attached. The lashes can be a continuous line of lashes or it can have segment lengths of lashes on tape.

In one embodiment, the invention is a dispenser that allows for easy application. Simply apply a strip of "lashes on tape" to the skin above the natural lash line. This can be done by several application types. One type of application is done by closing the eye, gently pulling the lash line outward to provide a flat smooth skin surface on which to apply "lashes on tape". Press dispenser onto skin, press the release, roll across lash line, dispenser releases "lashes on tape" strip to the upper eyelid lash-line. Clip the strip with the in-house clipper at the desired length. Proceed with the other eye.

Another application type is to simply roll desired amount of "lashes on tape", cut, peel away from backing and apply "lashes on tape." Apply lashes with adhesive side down on the skin above the lash line.

I claim:

1. An apparatus for dispensing false eyelashes comprising:

a casing having a first body and a second body, the first body and the second body coupled together such that an opening is preserved;

a first axle affixed to the first body proximate to the opening;

a second axle affixed to the first body located to a rear portion of the second body, behind the first axle;

a first wheel having a cylindrical hole that receives the first axel there through is arranged to have a cylindrical reel centered about the hole, the reel having a circumferential surface from which a false eyelash tape can be wound onto;

a second wheel having a cylindrical hole that receives the second axel there through is arranged to have a cylindrical reel centered about the hole, the reel having a circumferential surface from which a false eyelash tape can be wound off, the second wheel comprising false eyelash tape with false eyelashes spooled thereon;

an elastic tensioning element encompassing the first wheel and second wheel; and the false eyelash tape having a plurality of false eyelashes affixed thereto, and coupled between the first wheel and second wheel such that as the tape traverses from the second wheel to the first wheel at least one false eyelash is exposed for removal from the tape through the opening.

2. The apparatus in claim 1 further comprising a guide pin attached to the casing under the second wheel.

3. The apparatus in claim 1, in which the elastic tensioning element is made from rubber.

4. The apparatus in claim 1 further comprising a cutter is affixed via hinge to the casing allowing the cutter to cover a removal tip, the removable tip being attached to the apparatus proximate to the opening.

5. The apparatus in claim 1 further comprising:

a first guide rod connected to the first end of a first compression spring presses against the tape at the first wheel keeping tension on said tape and the second end of the first compression spring is coupled to the casing approximate to the first wheel; and a second guide rod connected to the first end of a second compression spring presses against the tape with eyelash keeping tension on said tape at the second wheel and the second end of the compression spring is coupled to the casing approximate to the second wheel.

6. The apparatus for dispensing false eyelashes according to claim 1, further comprising:

a first rotatable reel with a circular opening and a groove that fits a guide pin on the first wheel's cylindrical rod; and a second rotatable reel with a circular opening and a groove that fits a guide pin on the second wheel's cylindrical rod.

* * * * *